United States Patent [19]

Naffziger

[11] 4,269,564

[45] May 26, 1981

[54] FLOW CONTROL DEVICE

[75] Inventor: Larry C. Naffziger, Fresno, Calif.

[73] Assignee: Bank of America N.T. & S.A., Fresno, Calif.

[21] Appl. No.: 39,315

[22] Filed: May 16, 1979

Related U.S. Application Data

[63] Continuation-in-part of Ser. No. 947,610, Oct. 2, 1978, abandoned.

[51] Int. Cl.[3] ..... F04D 5/00

[52] U.S. Cl. ..... 415/53 R; 277/57; 415/170 R

[58] Field of Search ..... 415/53 R, 170 R; 277/57

[56] References Cited

U.S. PATENT DOCUMENTS

| | | | |
|---|---|---|---|
| 1,151,964 | 8/1915 | Peterson | 277/57 |
| 1,151,965 | 8/1915 | Peterson | 277/57 |
| 1,850,749 | 3/1932 | Frederick . | |
| 2,066,505 | 1/1937 | Wolfe . | |
| 2,270,054 | 1/1942 | Hogan . | |
| 2,957,711 | 10/1960 | Aspelin . | |
| 3,025,800 | 3/1962 | Wolfe et al. . | |
| 3,221,661 | 12/1965 | Swearingen . | |
| 3,512,788 | 5/1970 | Kilbane . | |
| 3,677,659 | 7/1972 | Williams . | |
| 3,796,507 | 3/1974 | Smykal et al. . | |
| 3,842,902 | 10/1974 | Poslusny . | |
| 3,843,065 | 10/1974 | Horstman et al. | 277/57 |

*Primary Examiner*—Harvey C. Hornsby
*Assistant Examiner*—Timothy F. Simone
*Attorney, Agent, or Firm*—Huebner & Worrel

[57] ABSTRACT

A flow control device for a fluid pump having a path for fluid flow therethrough substantially along a predetermined axis, the path having successive portions of reduced and enlarged size relative to each other substantially concentric to the axis, an impeller mounted for rotational movement within the portion of enlarged size to draw fluid along the path, the flow control device having a tubular member adapted to be mounted on the pump substantially coincident with the portion of reduced size and extending into the impeller for introducing the fluid flow thereto.

6 Claims, 10 Drawing Figures

FIG. 3
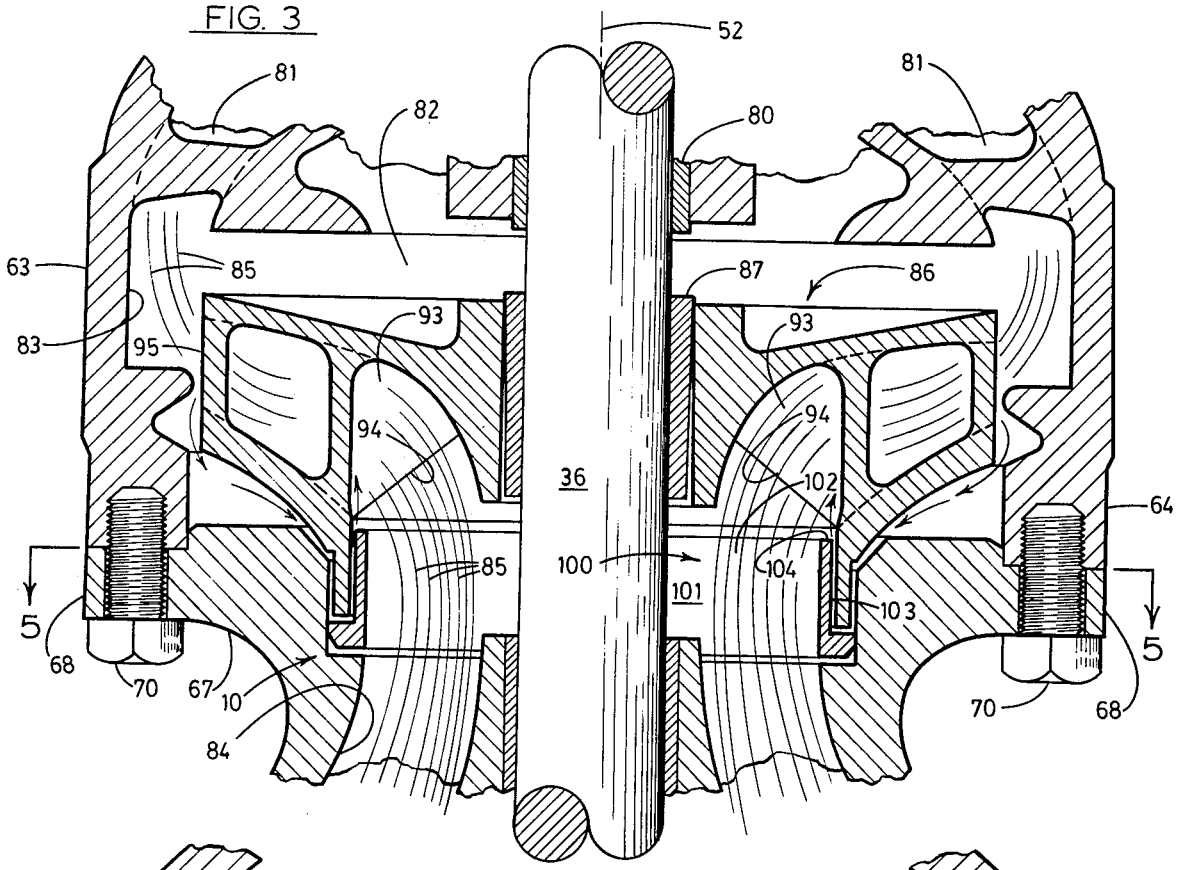
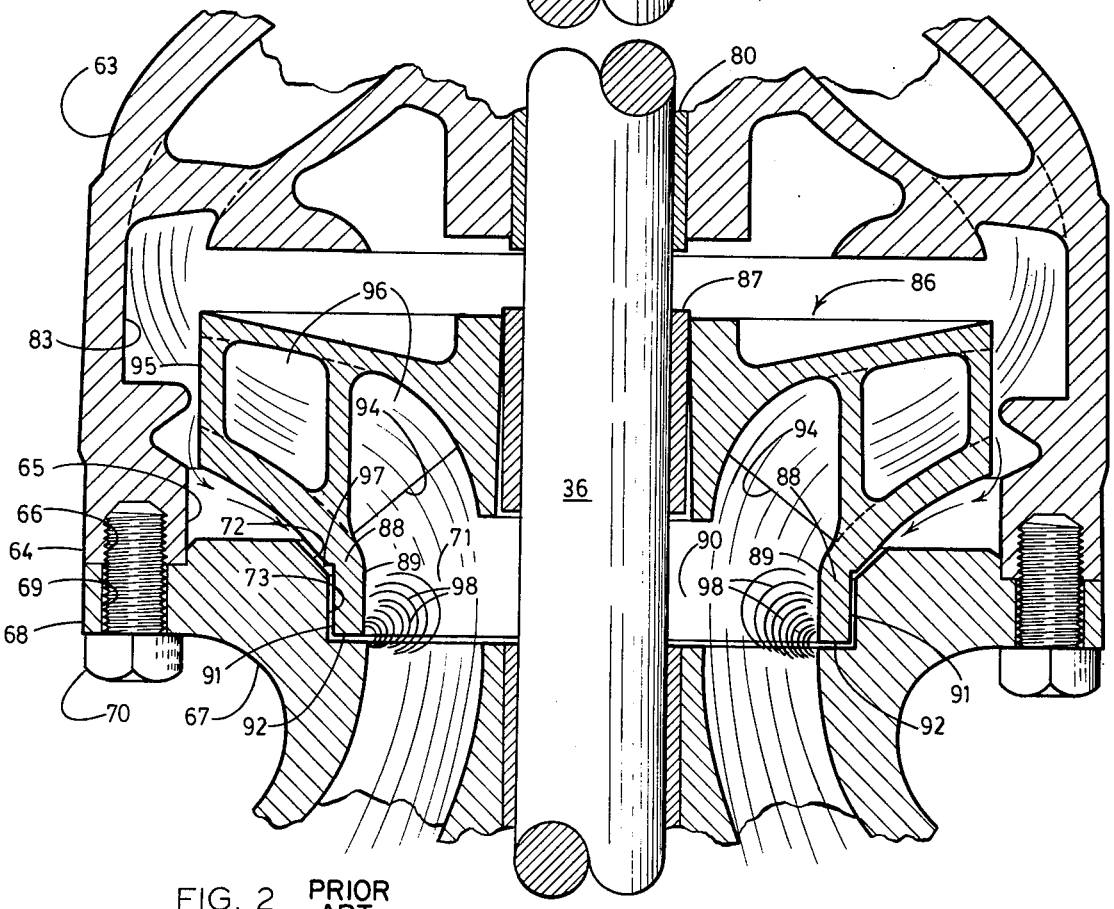
FIG. 2 PRIOR ART

FLOW CONTROL DEVICE

CROSS REFERENCE TO A RELATED APPLICATION

This application is a continuation-in-part of U.S. patent application Ser. No. 947,610, filed Oct. 2, 1978 abandoned and entitled "Turbine Pump Seal."

BACKGROUND OF THE INVENTION

1. Field of the Invention

The present invention relates to a flow control device which is operable in several different forms to control fluid flow in pumps particularly of the submersible water well type which conventionally are subject to rapid wear by the presence of particulate matter in the water. The flow control device of the present invention has particular utility in directing the flow of fluid through the pump in a manner which minimizes the destructive effects of such water borne substances as well as of recirculating water and which insures that the operational efficiency of the pump is maintained over an operational life far surpassing that heretofore achieved.

A chronic problem in the use of pumps, particularly of the type used in water wells, is their inability to operate at what theoretically should be their full capacity. Turbulence, recirculating water and the like impede their operation from the outset. These problems are aggravated to a great degree by particulate matter borne by the fluid stream. Although strainers and the like are commonly employed in an effort to remove foreign substances prior to passage through the operative portions of the pumps, it has been found impossible to eliminate much of the particulate matter without reducing pumping capacity below an acceptable level. As a result, the components of such pumps are continuously abraided by sand and the like during operation.

Conventional pump construction contributes further to a complication of these problems. Typically a pump housing is employed which has a constricted throat and an impeller is mounted above but extends into close association with the throat. The impeller is rotated at high speed to achieve the pumping action. A problem inherent in such construction is the recirculation of water about the impeller and back into the throat of the pump. This recirculation is inherently inefficient. However, it also causes turbulence at the throat of the pump and, it is believed, tends further to constrict the flow at that point. The recirculating water carries particulate matter with it. The close tolerance fit of the impeller and the pump housing at this point causes the surfaces thereof rapidly to be worn away which, in turn, increases the volume of water recirculated. This drastically reduces the operating efficiency of the pump. Furthermore, it places stress on the rotating impeller which in turn is transmitted to the drive shaft on which the impeller is mounted. The end result is that all such pumps rapidly wear themselves out and will eventually destroy themselves particularly in areas in which the water bearing formations contain high quantities of sand. Although various seals have been employed in an effort to limit such recirculation, none has heretofore been successful.

As a direct result, such pumps often can be operated for only a few months before becoming so inefficient as to require replacement of the worn components. This, of course, requires that the submersed pump structure be removed from the well which is extremely expensive. Whether operated inefficiently to avoid replacement, or replaced as frequently as needed, such conventional practices are costly to the operator, extremely wasteful of the energy used to operate the pump and result in prolonged "down time" for the pump which is in itself quite expensive.

Therefore, it has long been known that it would be desirable to have a device which maintains the operation of pumps at high efficiency over long operational lives minimizing the destructive effect of particulate matter passing through the pumps, reducing the expense required in maintaining such pumps and insuring that the energy employed in running the pumps is used most efficiently.

SUMMARY OF THE INVENTION

Therefore, it is an object of the present invention to provide an improved form of pump construction and, more particularly, a form of pump construction which can be used in a variety of forms to enhance the efficiency and prolong the operational lives of such pumps.

Another object is to provide such a device which can be employed in a variety of types of pumps, but has particular utility in high pressure, submersible water pumps.

Another object is to provide such a device which operates to introduce or inject the main column of water passing through a pump into the impeller in such a manner as to minimize turbulence and maximize the efficiency of the operation of the impeller.

Another object is to provide such a device which causes recirculating water to be directed into the impeller in a manner such as not to constrict the main column of water passing through the pump.

Another object is to provide such a device which operates to introduce recirculating water to the impeller at a position such as not to interfere with operation of the impeller.

Another object is to provide such a device which reduces the volume of water recirculated within the pump without the use of seals of the conventional type which are subject to rapid wear.

Another object is to provide such a device which injects recirculating water into the main column of water passing through the pump at a point such that the inherent pressure differential within the pump contributing to the recirculation of the water is reduced to a minimum so as to reduce the volume of water recirculated.

Another object is to provide such a device which can be employed in a wide variety of forms including, but not limited to, a form which can be installed in existing pumps, a form which can be manufactured as an integral part of a pump and a form which is particularly well suited to use with impellers having vanes of an elongated type.

A further object is to provide such a device which operates to insure that a pump in which the device is installed produces a maximum volume of water for a minimum quantity of energy expended.

Further objects and advantages are to provide improved elements and arrangements thereof in an apparatus for the purposes described which is dependable, economical, durable and fully effective in accomplishing its intended purposes.

BRIEF DESCRIPTION OF THE DRAWINGS

FIG. 2 is an enlarged fragmentary vertical section of a portion of a typical high pressure turbine pump housing of conventional construction.

FIG. 3 is a fragmentary vertical section of a pump housing such as shown in FIG. 2, but with the device of the present invention installed therein.

DESCRIPTION OF THE PREFERRED EMBODIMENT

Figure 5:
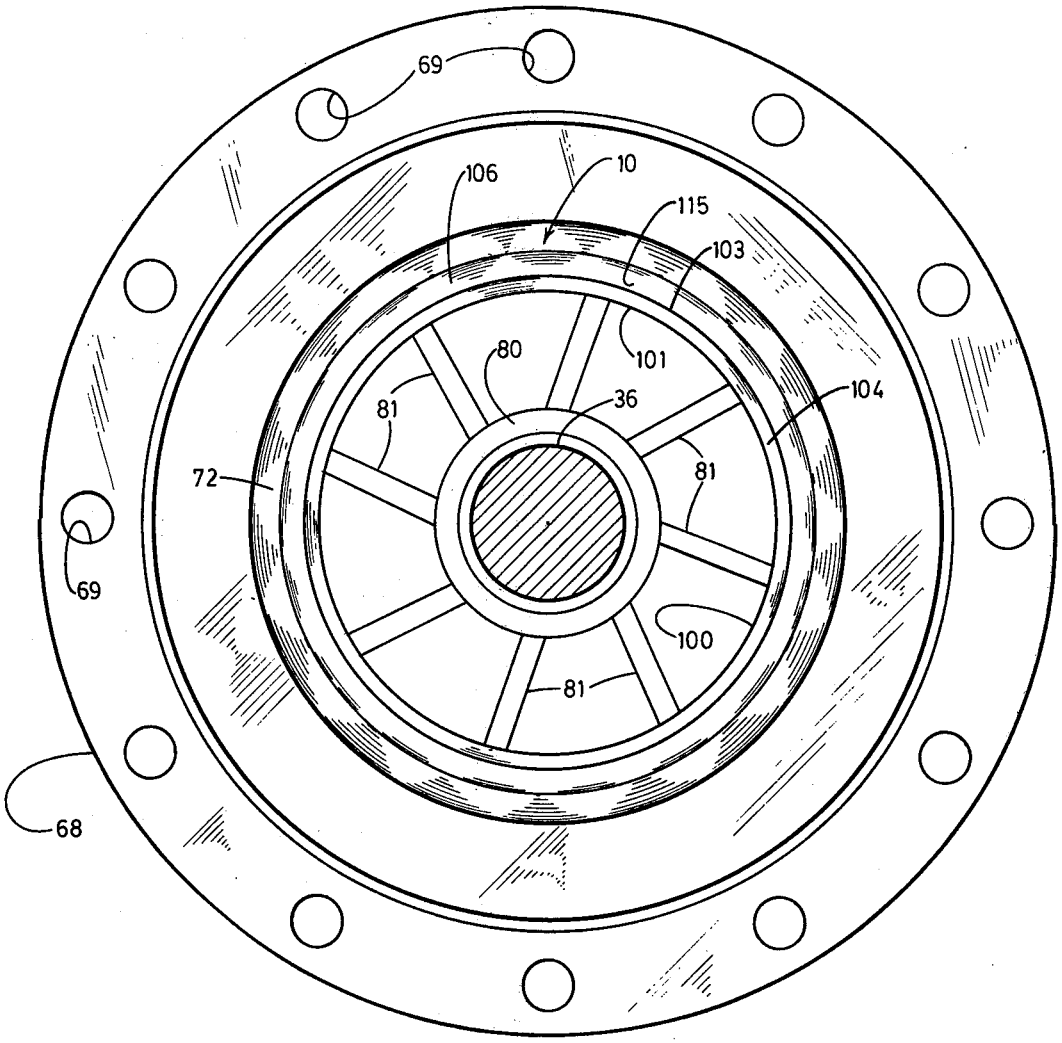
FIG. 5 is a top plan view of a pump housing with the flow control device installed therein taken from a position indicated by line 5—5 in FIG. 3.
Figure 4:
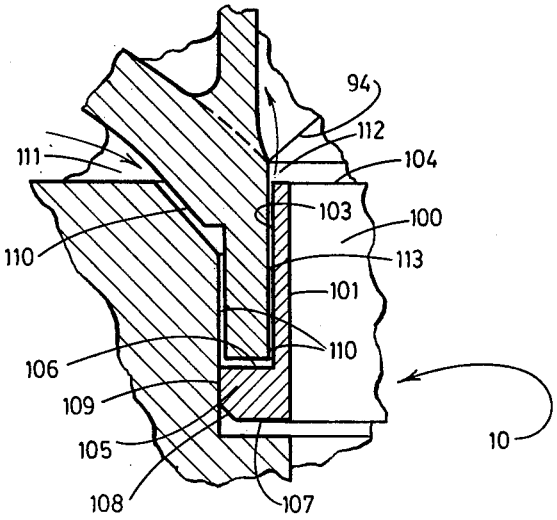
FIG. 4 is a somewhat enlarged fragmentary vertical section showing a portion of the flow control device shown in FIG. 3.
Figure 6:
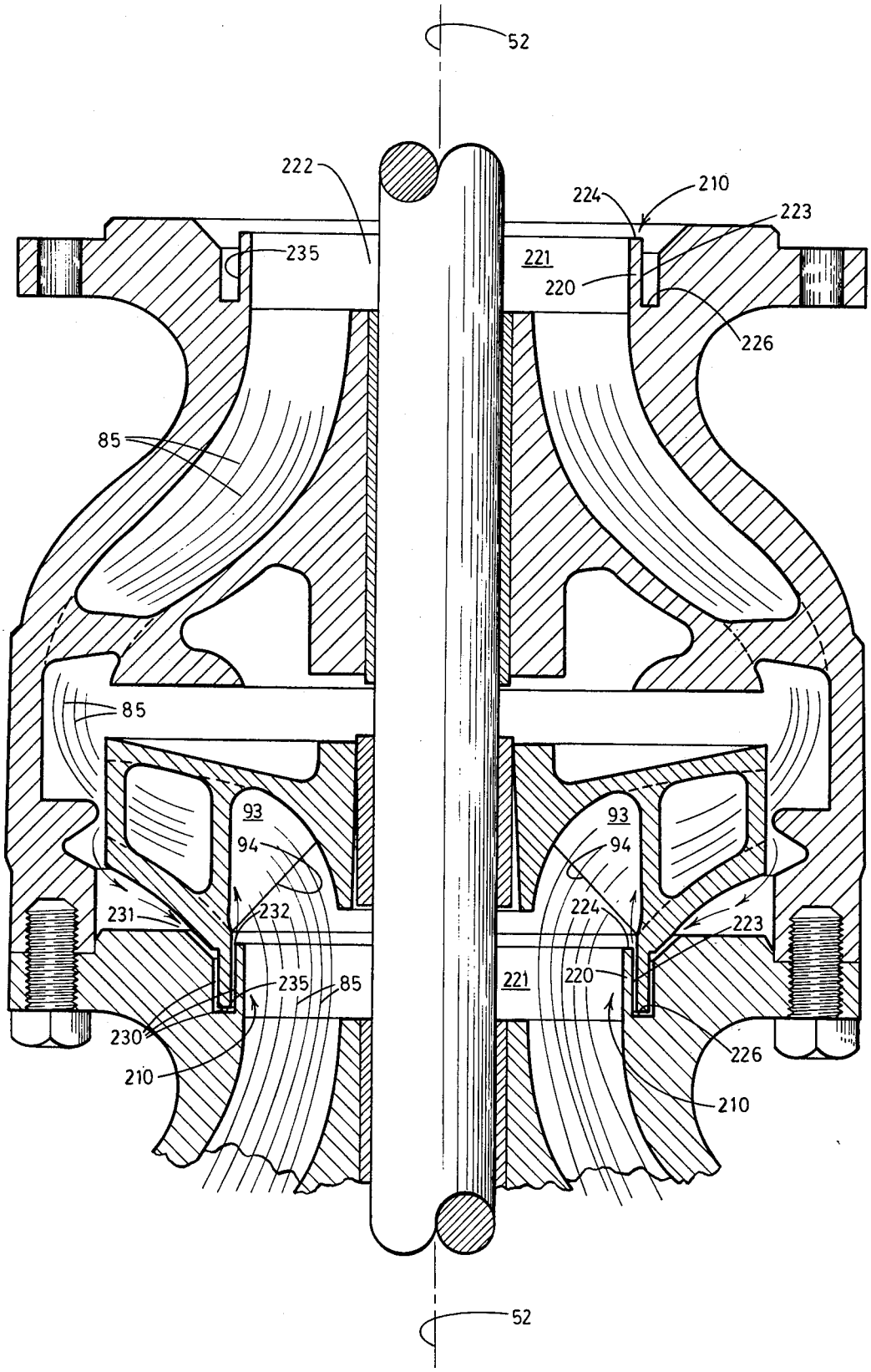
FIG. 6 is a fragmentary vertical section of a pump housing showing the flow control device of the second form of the present invention.

As heretofore discussed, the flow control device of the present invention can be constructed in a variety of forms so as to suit the needs of the particular pump within which it is to be used. The first form of the flow control device indicated by the numeral 10 and is shown in FIGS. 3, 4 and 5. The flow control device of the second form is indicated by the numeral 210 and is shown in FIG. 6. The flow control device of the third form of the invention is indicated by the numeral 310 and is shown in FIGS. 7, 8, 9 and 10.

First Form

Figure 1:
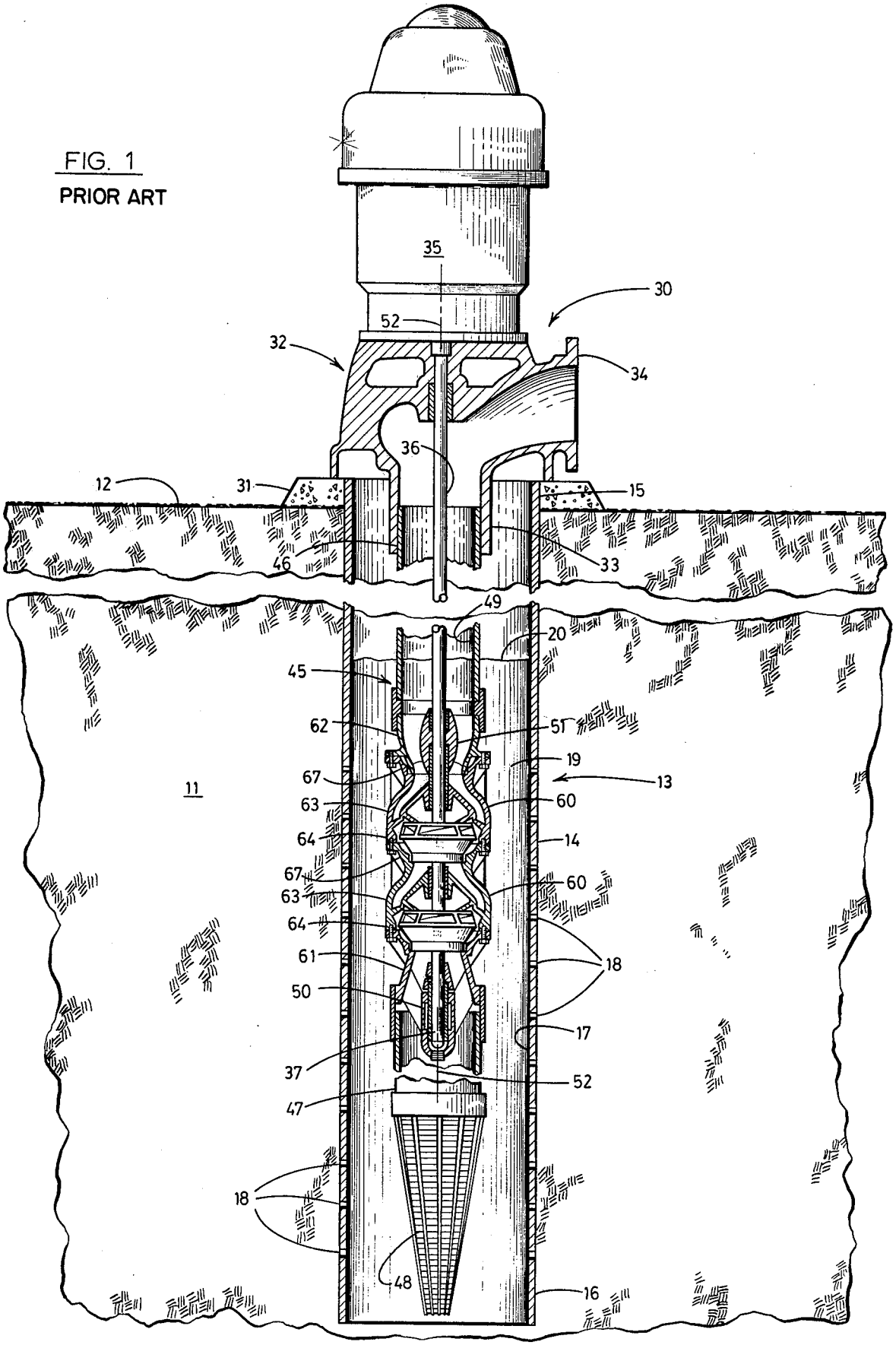
FIG. 1 PRIOR ART
FIG. 1 is a fragmentary vertical section showing a typical operative environment for the flow control device of the present invention.

FIG. 1 shows an operative environment characteristic of that within which all three forms of the present invention are adapted to be employed. As shown therein, the earth is indicated at 11 and the earth's surface at 12. A well 13 is formed in the earth and communicates with a water bearing formation in the earth. A well casing 14, having an upper end portion 15 and a lower end portion 16, is mounted in the well and has an interior 17. A plurality of perforations 18 extend through the casing so as to establish fluid communication between the water bearing formation within the earth and the interior of the casing. For illustrative convenience, water is indicated at 19 within the casing having an upper level or surface 20.

A pump assembly 30 is mounted in the well. The assembly includes a base 31 formed on the earth's surface 12 about the upper end portion 15 of the well casing 14. A pump head 32 is affixed on the base and has an intake coupling 33 communicating with the interior 17 of the well casing and a discharge coupling 34 for connection to any suitable conduit to carry off water pumped from the well. A drive motor 35 is secured on the pump head and mounts a drive shaft 36 in driven relation extending axially down the well casing to a remote end portion 37.

A column or education pipe assembly 45, having an upper end portion 46 and an opposite lower end portion 47, is mounted on the intake coupling 33 of the pump head 32. A strainer 48 is fastened on the lower end portion of the pipe assembly. The pipe assembly has an interior 49 and mounts a lower bearing assembly 50 and an intermediate bearing assembly 51 in supporting relation to the drive shaft 36 of the drive motor. The bearing assemblies mount the drive shaft for rotational movement about an axis of rotation 52 extending through and in axial alignment with the pipe assembly.

The pump assembly 30 has a plurality of pump stages or bowl assemblies 60 mounted in succession on the pipe assembly 45. The pump assembly 30 can be provided with the number of such pump stages necessary to produce the volume of water desired for a given depth of operation. It will be understood that although only two such pump stages are shown in FIG. 1, the pump assembly can have as many as twenty or more such stages.

Each of the pump stages is substantially identical, as can be seen in FIGS. 1, 2 and 3. The pump stages compose an integral part of the pipe assembly 45 and are held in axially aligned relation in the pipe assembly by an intake bowl assembly 61 and an upper discharge bowl assembly 62. Each of the pump stages therebetween has a pump housing known as a bowl casting or housing 63, having a lower end portion 64 defining a lower opening 65. The lower end portion of each bowl housing has a plurality of screw threaded bolt holes 66. Each bowl housing has an upper end portion 67 mounting a radial flange 68. The flange has a plurality of bolt holes 69 arranged to match the bolt holes 66 of another bowl housing. Successive bowl housings are mounted in axial alignment by bolts 70 individually extending through the bolt holes 69 of a lower bowl housing and screw-threadably secured in the bolt holes 66 of the next successive bowl housing, as can be seen in FIGS. 1, 2 and 3.

The upper end portion 67 of each bowl housing 63 defines an upper opening 71 circumscribed by beveled shoulder 72. The upper opening is also circumscribed by a counterbore 73 of predetermined dimensions.

Each bowl housing 63 has a bearing assembly 80 adjacent to the upper opening 71 thereof and disposed in axial alignment with the bowl housing. Extending about the bearing assembly and toward the upper opening are a plurality of bowl vanes 81 forming volutes for imparting a swirling action to the water discharged therealong toward the upper opening. The bearing assembly 80 and the lower opening 65 of the bowl housing define an impeller chamber 82 therebetween. As can best be seen in FIGS. 2 and 3, each bowl housing has an enlarged interior surface 83 bounding the impeller chamber 82 and a constricted interior surface or throat 84 leading to the upper opening 71. The interior of each bowl housing thus defines a fluid path as indicated in the drawings by flow lines 85.

An impeller 86, having a central mounting assembly 87, is secured on the drive shaft 36 within the impeller chamber 82 of each bowl housing 63, as shown in FIG. 2. The impeller has a cylindrical portion skirt 88 of substantially cylindrical construction. The impeller skirt is received for rotational movement in the counter bore 73 of the adjoining bowl housing in a close tolerance fit. The impeller skirt has an interior surface 89 defining a passage 90 which, in the assembled relation shown in FIG. 2, communicates with and constitutes an extension of the throat 84 of the adjoining bowl housing therebelow. The impeller skirt has an exterior surface 91 and a lower edge surface 92.

Each impeller 86 has a plurality of impeller vanes 93 extending from leading edges 94 adjacent to the interior surface 89 of the impeller skirt 88 to trailing edges 95 at the periphery of the impeller. The vanes define passages 96 which, with the vanes, extend in volutes for pumping water therethrough and through its respective bowl housing 63 during operation. The exterior surface 91 and edge surface 92 of the impeller and the beveled shoulder 72 and counter bore 73 of the bowl housing define a path of recirculation 97 along which water passes during operation of the pump assembly 30. Although various seals have been used in an effort to stop this recirculation, none has been successful. The recirculation of water in this manner creats turbulence, indicated for illustrative convenience at 98, within the main column of water at the throat 84.

The flow control device 10 of the first form of the present invention is shown in FIGS. 3, 4 and 5. The device has an annular wall or ring 100 of cylindrical construction. The ring has an interior surface 101 bounding a cylindrical passage 102. The ring has an exterior surface 103 which is preferably, although not necessarily, parallel to the interior surface of the ring. The interior and exterior surfaces extend to an edge surface 104.

The device 10 has a radial flange 105 extending outwardly from the annular ring in spaced relation to the edge surface 104 thereof. The flange has an upper surface 106 which is preferably, although not necessarily, substantially right angularly related to the exterior surface 103 of the ring. Similarly, the radial flange has a lower surface 107 remote from the edge surface 104 and extending radially to a beveled shoulder 108. The flange extends to a peripheral surface 109 of predetermined diameter.

When the flow control device 10 is mounted in operable position, as best shown in FIG. 3, the upper end portion 67 of the bowl housing 63, the impeller skirt 88, the upper surface 106 of the radial flange 105 and exterior surface 103 of the annular ring 100 define a path of recirculation 110 leading from an intake 111 adjacent to the beveled shoulder 72 of the bowl housing to an annular discharge 112 at the edge surface 104 of the annular ring. In order to accept the flow control device 10 in assembled relation as shown in FIG. 3, the interior surface 89 of the impeller skirt is first machined to form a machined interior surface 113 of predetermined greater diameter than interior surface 89 as shown in FIG. 2.

The flow control device 10 is mounted in position, after formation of the machined surface 113, by press fitting the radial flange 105 into the counter bore 73 to the position shown in FIG. 3 so as to form an annular slot 115 for receipt of the impeller skirt 88. It will be understood that the specific dimensions of the flow control device are such that when the device is mounted in the operable position shown in FIG. 3, the interior surface 101 of the annular ring is substantially coplanar with the throat 84 of the bowl housing 63 within which the device is mounted. Similarly, the dimensions of the device are such that the edge surface 104 of the annular ring extends inwardly of the impeller skirt at least one half of the length of the skirt and, as shown in FIG. 3, to a position in juxtaposition to the leading edges 94 of the impeller vanes 93. Similarly, the dimensions of the device are such that the path of recirculation 110 defined by interfitting of the impeller skirt 88 in the annular slot 115 so formed provides a close tolerance fit. Thus, the impeller skirt moves in close association to be spaced from the stationary surfaces of the bowl housing and the flow control device.

Second Form

The flow control device 210 of the second form of the present invention is closely similar in structure and operation to device 10 previously described. However, device 210 is formed as an integral part of the bowl housing 63 at the time of manufacture rather than being designed to be mounted in existing bowl housings. The flow control device 210 is shown in FIG. 6.

Device 210 has an annular wall or ring 220 borne by the upper end portion 67 of the bowl housing 63. The ring has a substantially cylindrical interior surface 221 which is substantially coplanar and forms an extension of the throat 84 of the bowl housing. The ring bounds a cylindrical passage 222 and has an exterior surface 223 preferably, although not necessarily, substantially parallel to the interior surface 221. The interior and exterior surfaces extend to an edge surface 224. The device 210, as it forms an integral part of the bowl housing, has an upper surface 226 spaced from the edge surface 224 and disposed preferably, although not necessarily, in substantially right angular relation to the interior and exterior surfaces of the annular ring.

As in flow control device 10, device 210 as it is interfitted with the impeller skirt 88 of the impeller 86, forms a path of recirculation 230 leading from an intake 231 adjacent to the beveled shoulder 72 of the bowl housing to a discharge 232 at the edge surface 224 of the ring 220. The flow control device defines an annular slot 235 within which the impeller skirt 88 is received, as best shown in FIG. 6.

Third Form

Figure 8:
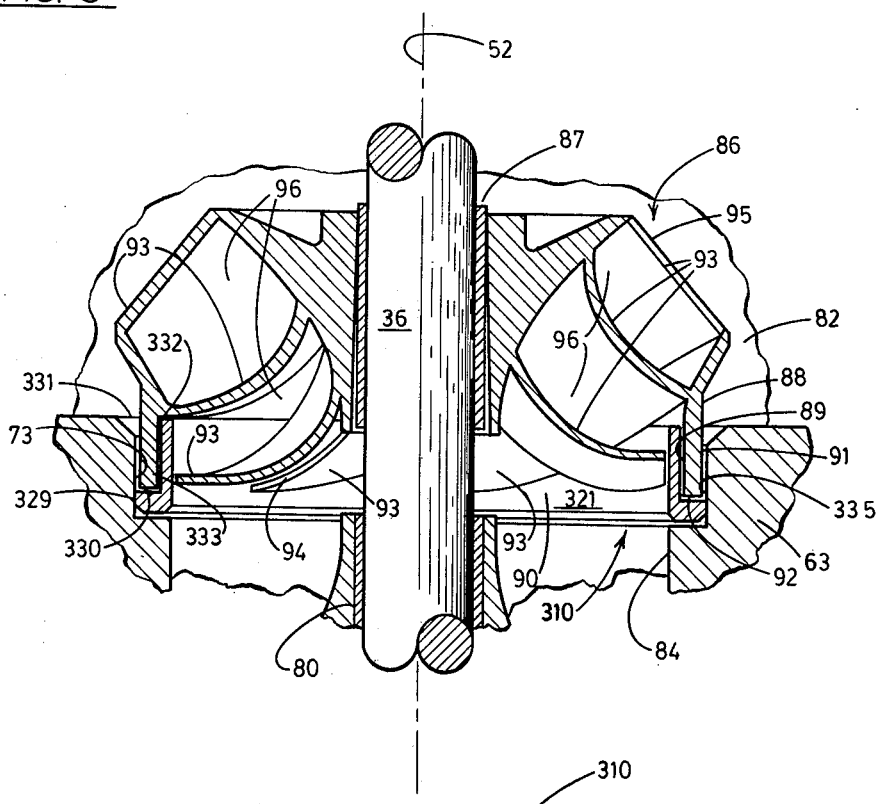
FIG. 8 is a fragmentary vertical section taken from a position indicated by line 8—8 in FIG. 7 and showing the flow control device of the third form installed in a pump housing in operable relation to the impeller of FIG. 7.
Figure 7:
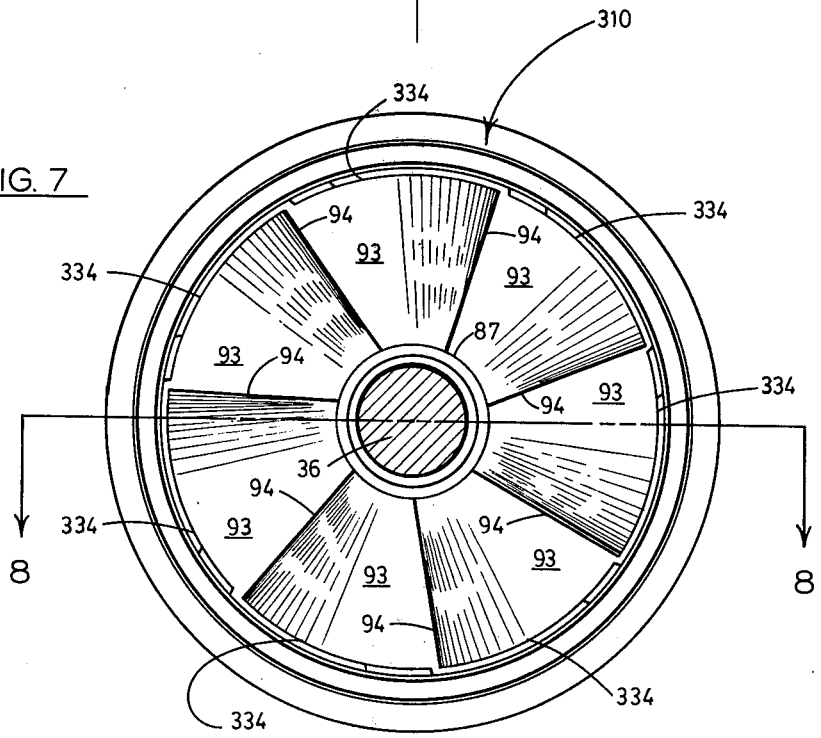
FIG. 7 is a bottom plan view of the flow control device of the third form of the present invention disposed in its operable position in an impeller of a type wherein the vanes extend into the area circumscribed by the skirt of the impeller.
Figure 10:
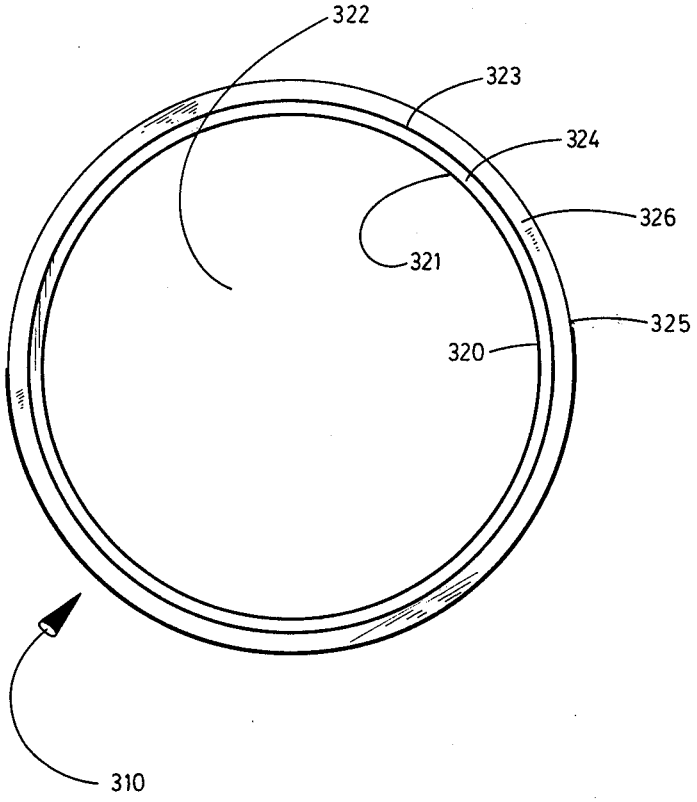
FIG 10 is a top plan view of the flow control device of FIG. 8.
Figure 9:
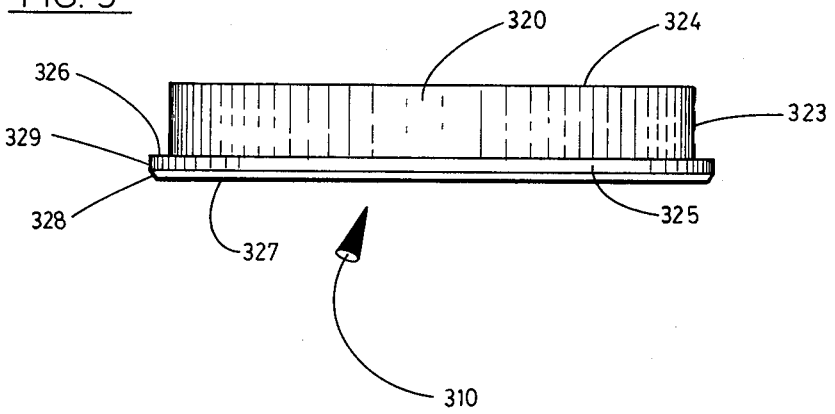
FIG. 9 is a side elevation of the flow control device of FIG. 8.

The flow control device 310 of the third form of the present invention is shown in FIGS. 7 through 10. Device 310 is closely similar in structure and operation to both the first and second forms of the invention. For illustrative convenience, the impeller with which the flow control device 310 is designed to be used is shown in FIGS. 7 and 8 and bears numerals identical to impeller 86 insofar as their corresponding parts are concerned. The device 310 can be adapted for installation in existing conventional bowl housings, as shown in the drawings, or can be formed at the time of manufacture as an integral part of the bowl casting as in the case of device 210.

The flow control device 310 has an annular wall or ring 320 having an interior surface 321 bounding a cylindrical passage 322. The annular ring has an exterior surface 323 and extends to an edge surface 324.

The device 310 has a radial flange 325 extending radially from the ring 320 and having an upper surface 326 preferably, although not necessarily, right-angularly related to the exterior surface 323 of the ring. The radial flange has a lower surface 327 also preferably, although not necessarily, right-angularly related to the exterior surface of the ring. The lower surface extends to a beveled shoulder 328. The radial flange extends to a peripheral surface 329 of predetermined diameter adapted to be press fitted within the counter bore 73 of the bowl housing 63 to the position best shown in FIG. 8.

As in the other forms of the invention, when the flow control device 310 is mounted in position as shown in FIG. 8, the surfaces 323 and 326 thereof together with the impeller skirt 88 and the bowl housing define a path of recirculation 330 extending from an intake 331 adjacent to the beveled shoulder 72 of the bowl housing to a discharge 332 at the edge surface 324 of the annular ring 320.

Where the device 310 is to be fitted within an existing conventional bowl housing 63, the interior surface 89 of the impeller skirt 88 is machined to form a machine surface 333 of predetermined greater diameter. Similarly, the form of the impeller 86 shown in FIG. 8 has vanes 93 with leading edges 94 which extend into positions joining the interior surface 89 of the impeller skirt well within the cylindrical passage 90. The machines surface 333 is formed in such a manner as also to cut away a small portion of each of the vanes at its periphery so as to form slots 334 therein for receipt of the ring 320 therewithin, as best shown in FIGS. 7 and 8. As in devices 10 and 210, ring 320 forms an annular slot 335 in assembled condition adapted to receive the impeller skirt 88 as shown in FIG. 8.

OPERATION

The operation of the described embodiments of the subject invention are believed to be clearly apparent and are briefly summarized at this point. Since the operative effect of the flow control devices 10, 210 and 310 are substantially identical, for convenience they will be described simultaneously.

With the devices 10, 210 and 310 mounted on their operative positions in their respective bowl housings as heretofore described, in each case the pump assembly 30 thereof is assembled in the well 13, as best shown in FIG. 1. Operation of the pump assembly 30 is initiated in the conventional fashion by operating the drive motor 35 to cause the impellers 86 of the various pump stages 60 to be rotated at high speed by the drive shaft 36. Such operation of the pump assembly 30, acting upon the water 19 within the pump stages, causes water within the well casing 14 to be drawn upwardly in the education pipe assembly 45. Continued operation creates a stream or column of fluid movement along the fluid path 85 from the well casing through the strainer 48, the intake bowl assembly 61, the pump stages 60, through the remainder of the pipe assembly 45 and from the discharge coupling 34.

Within each pump stage 60 the column of water passes through the throat 84 of the lower bowl housing 63 or intake bowl assembly 61 through the cylindrical passages 102, 222 and 322 of the respective devices 10, 210 and 310 of that pump stage, through the passages 96 defined by the impeller vanes 93, into the portion of the fluid path within the impeller chamber 82, and subsequently along the bowl vanes 81 to the throat 84 of that pump stage and into the next successive pump stage.

It will be seen that since the interior surfaces 101, 221 and 321 of the annular rings 100, 220 and 320 are substantially coplanar with the throats 84 of the bowl housings, the column of water being pumped through the pump stages is not disrupted by turbulence from uneven surfaces. Similarly, the paths of recirculation 110, 230 and 330 are directed by the flow control devices in such a manner that there is no influx or constrictive movement of recirculating water into the column of water passing through the throat as occurs in conventional devices as depicted in FIG. 2. Thus, no turbulence such as represented at 98 in FIG. 2 occurs. It has been found that the pumping efficiency of the various pump stages is, as a result, substantially improved as can perhaps best be visualized by comparison with FIG. 3.

As can be seen in FIGS. 3, 6 and 8, the edge surfaces 104, 224 and 324 respectively of the devices 10, 210 and 310 extend well into the passages 90 of their respective impellers to positions in juxtaposition to the leading edges 94 of the impeller vanes 93. In the case of device 310, the edge surface 324 extends beyond the leading edges of the impeller vanes 93 and is received in the slots 334, as best shown in FIG. 8. The annular rings 100, 220 and 320 of the devices thus feed or inject the column of water into the eye of the impeller where the impeller operates most efficiently to move the column and where the least turbulence is created. Consequently, each impeller is able to operate at optimum efficiency and power.

Similarly, it has been found that the paths of recirculation 110, 230 and 330 defined by the flow control devices 10, 210 and 310 inject the recirculating water out through their respective discharges 112, 232 and 332 at points well within the impellers so as to produce the maximum benefit from such recirculation. Still further the point of discharge of the recirculating water is at a position in close association with the rotating leading edges 94 of the impeller vanes 93. This causes a minimization of any disruptive effect resulting from such recirculation. In fact it is believed this close association between the point of discharge and the vanes may create a back pressure resisting recirculation of the water. These same operative effects occur also with the flow control device 310 in that the point of discharge is within the slot 334 of the vanes.

Still further, it is believed that recirculation within the pump stages 60 of conventional pumps is generated by a disparity in fluid pressure within each bowl housing, or that such a disparity may contribute to this recirculation. This, disparity or pressure differential may be a result of a venturi effect created by constriction of the fluid flow at the throat 84 of the bowl housing. The fluid pressure is thus decreased by the constriction at the throat relative to the pressure within the impeller chamber. Thus, there is a natural tendency for the water to move from the high pressure area within the impeller chamber to the comparatively low pressure area at the throat. It is known, as can be seen in FIG. 2, that a substantial volume of water is injected at right angles to the fluid stream at the throat, whether caused by a pressure differential or not. In any event, this injection causes considerable turbulence, further constricts the fluid column at that point and substantially reduces the operating efficiency of the pump.

The particulate matter borne by such recirculating water in conventional construction rapidly wears away the metal surfaces so as to increase the size of the path along which recirculating water is traveled. This progressively increases the volume of water recirculated vastly reducing the efficiency of the pump and contributing markedly to destruction of the pump components. In this regard, wearing of the surfaces of the impeller and the bowl housing cause strain to be placed on the impeller and drive shaft which can rapidly lead to destruction of the bowl assemblies. Similarly, the leading edges 94 of the impeller blades 93 are rapidly worn away in conventional arrangements.

However, with the flow control devices 10, 210 and 310 of the present invention, the points of discharge 112, 232 and 332 are, in each case, well within the impeller and in much closer association to the higher pressure area within the impeller chamber. It is believed that this point of discharge effectively reduces the fluid pressure differential to which reference has been made and that the volume of water recirculated is thereby reduced. With reduction of the volume of water recirculated by the flow control devices, there is a considerable reduction in the wearing effect caused by particulate matter borne by the water. Similarly, even as to such wearing which does occur over a long period of use, the injection of the recirculating water at a point least disruptive to the column of fluid being pumped insures that the efficiency of the pump is maintained at a high level over a much longer period of use than has heretofore been achieved. It has been discovered that wearing of the leading edges 94 of the impeller vanes 93 is dramatically reduced from that experienced with conventional arrangements.

Therefore, the flow control device, in its various forms, of the present invention maintains the operation of pumps at high efficiency over long operational lives minimizing the destructive effects of particulate matter passing through the pumps, substantially reducing the expense required in maintaining such pumps and insuring that the energy employed in running the pumps is used most efficiently.

Although the invention has been herein shown and described in what are conceived to be the most practical and preferred embodiments, it is recognized that departures may be made therefrom within the scope of the invention, which is not to be limited to the illustrative details disclosed.

Having described my invention, what I claim as new and desire to secure by Letters Patent is:

1. A flow control device for a fluid pump having a throat and housing an impeller rotational about an axis of rotation to draw fluid through the throat and into the impeller and the impeller having a substantially cylindrical portion of predetermined length extending toward the throat substantially concentric to the axis of rotation, the flow control device comprising a substantially cylindrical wall borne by the pump extending inwardly of and substantially concentric to the cylindrical portion of the impeller at least one half the length of said cylindrical portion and spaced inwardly therefrom to form a path, for fluid recirculating about the cylindrical portion of the impeller, extending between the cylindrical wall of the flow control device and the cylindrical portion of the impeller to an annular discharge within the impeller disposed to release said recirculating fluid along a path not converging on said axis of rotation.

2. The flow control device of claim 1 in which the throat of the pump has a predetermined diameter and wherein said cylindrical wall of the flow control device has a substantially cylindrical interior surface facing the axis of rotation having a diameter substantially equal to the diameter of the throat of the pump and extending into the cylindrical portion of the impeller substantially to isolate the cylindrical portion of the impeller from the fluid passing into the impeller from the throat of the pump.

3. The flow control device of claim 1 in which the impeller of the pump has vanes with leading edges and wherein the cylindrical wall of flow control device extends into the impeller to a position such that said annular discharge is disposed in juxtaposition to and facing the leading edges of impeller vanes.

4. The flow control device of claim 1 in which the impeller of the pump has vanes extending from leading edges adjacent to the throat of the pump to discharge edges remote therefrom, the peripheries of the vanes at said leading edges have slots substantially concentric to the axis of rotation and wherein the cylindrical wall of the flow control device extends to an edge received within said slots.

5. In a fluid pump having a casing enclosing a constricted throat communicating with an enlarged chamber, an impeller mounted in the casing for rotation about an axis of rotation and having a substantially cylindrical portion extending toward said throat of the casing substantially concentric to the axis of rotation and vanes mounted within the impeller operable upon rotation of the impeller about said axis of rotation to draw fluid through the throat of the casing the cylindrical portion of the impeller and into the chamber of the casing while causing a portion of said fluid to be recirculated from the chamber about the exterior of the cylindrical portion of the impeller and back into the fluid passing from the throat of the casing, an improvement comprising a cylindrical wall borne by the casing concentric to the axis of rotation and the cylindrical portion of the impeller and extending from a position adjacent to the throat of the casing into the interior of the cylindrical portion of the impeller inwardly spaced therefrom and extending to a position adjacent to the vanes to divert said recirculated fluid along a path concentric and substantially parallel to the axis of rotation for discharge therefrom toward the vanes in a direction not convergent upon the axis of rotation.

6. A flow control device for a fluid pump having a throat and housing an impeller rotational about an axis of rotation to draw fluid through the throat and into the impeller and the impeller having a substantially cylindrical interior surface of predetermined length extending toward the throat, the flow control device comprising a wall adapted to be mounted on the pump extending inwardly of said interior surface of the impeller at least one half the length of said interior surface and spaced inwardly therefrom to form a path, for fluid recirculating about the impeller, extending to a discharge within the impeller disposed to release the recirculating fluid along a path not substantially converging on said axis of rotation.

* * * * *

UNITED STATES PATENT AND TRADEMARK OFFICE

CERTIFICATE OF CORRECTION

PATENT NO. : 4,269,564

DATED : May 26, 1981

INVENTOR(S) : Larry C. Naffziger

It is certified that error appears in the above-identified patent and that said Letters Patent are hereby corrected as shown below:

Column 4, Line 7, delete "education" and insert ---eduction---;

Column 4, Line 67, between "portion" and "skirt" insert ---or---;

Column 7, Line 48, delete "education" and insert ---eduction---.

Signed and Sealed this

*Eighteenth* Day of *August 1981*

[SEAL]

*Attest:*

GERALD J. MOSSINGHOFF

*Attesting Officer*

*Commissioner of Patents and Trademarks*